US007137258B2

(12) United States Patent
Widener

(10) Patent No.: US 7,137,258 B2
(45) Date of Patent: Nov. 21, 2006

(54) SWIRLER CONFIGURATIONS FOR COMBUSTOR NOZZLES AND RELATED METHOD

(75) Inventor: Stanley Kevin Widener, Greenville, SC (US)

(73) Assignee: General Electric Company, Schenectady, NY (US)

( * ) Notice: Subject to any disclaimer, the term of this patent is extended or adjusted under 35 U.S.C. 154(b) by 189 days.

(21) Appl. No.: 10/859,238

(22) Filed: Jun. 3, 2004

(65) Prior Publication Data

US 2005/0268616 A1 Dec. 8, 2005

(51) Int. Cl.
*F23R 3/14* (2006.01)

(52) U.S. Cl. ..... 60/776; 60/737; 60/748; 60/747

(58) Field of Classification Search ..... 60/737, 60/748, 746, 747, 776
See application file for complete search history.

(56) References Cited

U.S. PATENT DOCUMENTS 4,982,570 A 1/1991 Waslo et al.
5,094,610 A * 3/1992 Mandai et al. ..... 431/183
5,193,346 A 3/1993 Kuwata et al.
5,199,265 A 4/1993 Borkowicz
5,228,283 A 7/1993 Sciocchetti
5,251,447 A 10/1993 Joshi et al.
5,253,478 A 10/1993 Thibault, Jr. et al.
5,259,184 A 11/1993 Borkowicz et al.
5,351,477 A 10/1994 Joshi et al.
5,511,375 A 4/1996 Joshi et al.
5,713,205 A 2/1998 Sciocchetti et al.
5,722,230 A 3/1998 Cohen et al.
5,729,968 A 3/1998 Cohen et al.
5,865,024 A 2/1999 Kress et al.
5,916,142 A 6/1999 Snyder et al.
6,397,602 B1 6/2002 Vandervort et al.
6,438,961 B1 8/2002 Tuthill et al.
6,502,399 B1 * 1/2003 Mandai et al. ..... 60/748
6,832,481 B1 * 12/2004 Koenig et al. ..... 60/737

OTHER PUBLICATIONS

"Dry Low NOx Combustion System for Utility Gas Turbine," R.M. Washam, General Electric Company, undated.

* cited by examiner

*Primary Examiner*—Ted Kim
(74) *Attorney, Agent, or Firm*—Nixon & Vanderhye, P.C.

(57) ABSTRACT

A combustor includes a center nozzle surrounded by a plurality of outer nozzles, the center nozzle and each of the outer nozzles having a fuel passage and an air passage, with a swirler surrounding the fuel passage and having a plurality of vanes projecting radially within the air passage, each vane having a trailing edge arranged at a swirl angle relative to a longitudinal axis of the nozzle, wherein the swirl angle for the swirler in the center nozzle is different than the swirl angle for the swirlers in the plurality of outer nozzles.

8 Claims, 3 Drawing Sheets

SWIRLER CONFIGURATIONS FOR COMBUSTOR NOZZLES AND RELATED METHOD

BACKGROUND OF THE INVENTION

This invention relates to land-based gas turbine engines and specifically, to a "can-annular" combustor arranged with one center fuel nozzle surrounded by several radially outer fuel nozzles. More specifically, the invention relates to configurations of the center nozzle and outer nozzles so as to avoid flame attachment for selected nozzles at all operating conditions by incorporating a swirler device with a deliberately low-swirl aerodynamic design.

In gas turbine combustors utilizing DLN (dry low NOx) technology, it has been observed that there is a strong linkage between combustor dynamics (unsteady pressure fluctuations) and the "attachment" or "detachment" of the flame from one or several nozzles. An attached flame is anchored closely to the nozzle exit by the recirculation pattern in the vortex breakdown region. A detached flame is not anchored and exists several inches downstream of the nozzle exit. Attachment or detachment can be influenced by the fuel-air ratio, i.e., richer nozzles tend to run attached while leaner nozzles tend to run detached. In some designs, at the normal operating condition, it is not possible to provide sufficient fuel to all nozzles to keep all flames attached. In the process of tuning fuel splits, i.e., adjusting the relative quantity of fuel supplied to each nozzle, it has been found that optimum dynamics are obtained with some nozzle flames detached and some attached, but that sometimes large increases in dynamics are encountered where one or more nozzles are near their transition between flame attachment and flame detachment.

In accordance with current practice, all of the nozzles in a combustor assembly incorporate swirlers that have vanes shaped to provide a nominally high-swirl angle in order to maximize the aerodynamic stability via vortex breakdown. Specifically, it is common practice for the vane swirl angle to be in the range of 40°–50° relative to the longitudinal axis of the nozzle. In general, high-swirl angles promote a wider range of conditions at which the flame will attach. At the same time, fuel splits are used to tune in the field or in the lab to find the combination of attached and detached flames that results in the best dynamics—NOx tradeoff.

BRIEF DESCRIPTION OF THE INVENTION

In one exemplary embodiment, the swirl vanes on the center nozzle are redesigned to produce a swirl angle of less than 30° and preferably between 10° and 20°. The lower swirl angle assures that the center nozzle flame will be detached at all operating modes. At the same time, all of the radially outer nozzles continue to utilize swirlers with vanes producing a high-swirl angle of between 40° and 50° so that the outer nozzles' flames remain attached, with the detached center flame stabilized by the surrounding flames. Thus, the fuel from the center nozzle burns further downstream, resulting in lower NOx.

In a second exemplary embodiment, the swirler configuration is reversed so that the vanes on the swirlers in the radially outer nozzles have low-swirl angles while the vanes on the swirler in the center nozzle have a high-swirl angle. In this configuration, the center flame will be attached and the outer flames will be detached, also resulting in reduced NOx emissions.

Accordingly, in one aspect, the present invention relates to a combusto°mprising a center nozzle surrounded by a plurality of outer nozzles, the center nozzle and each of the outer nozzles having a fuel passage and an air passage, with a swirler surrounding the fuel passage and having a plurality of vanes projecting radially within the air passage, each vane having a trailing edge arranged at a swirl angle relative to a longitudinal axis of the nozzle, wherein the swirl angle for the swirler in the center nozzle is less than 30° and the swirl angle for the swirlers in the plurality of outer nozzles is between 40°–50.

In another aspect, the present invention relates to a nozzle for use in a can-annular combustor comprising a nozzle body including a center tube defining a fuel passage and an outer tube defining an air passage, with a swirler located radially between the center tube and the outer tube, the swirler including a plurality of vanes circumferentially spaced about the center tube, each vane having a trailing edge arranged at an angle of less than 30° relative to a longitudinal axis of the nozzle body.

In still another aspect, the present invention relates to a method for reducing NOx in a can-annular combustor comprising the steps of: (a) arranging a plurality of outer nozzles in an annular array about a center nozzle, each nozzle having a fuel passage and an air passage; (b) incorporating a swirler in the center nozzle supporting the fuel passage having vanes with injection orifices for injecting fuel into the air passage, each vane shaped to create a first-swirl angle relative to a longitudinal axis of the center nozzle of less than 30°; and (c) incorporating swirlers in each of the outer nozzles surrounding the fuel passages having vanes with injection orifices for injecting fuel into the air passage, each vane shaped to create second swirl angle relative to a longitudinal axis of the respective outer nozzles of between 40°–50°.

The invention will now be described in connection with the drawings identified below.

DETAILED DESCRIPTION OF THE INVENTION

Figure 1:
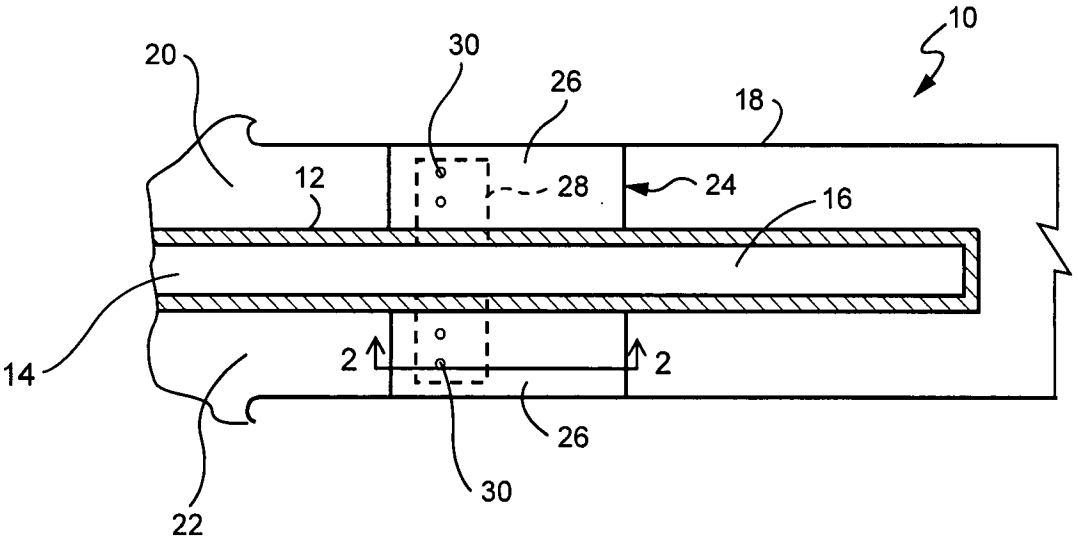
Fig. 1 (Prior Art)
FIG. 1 is a simplified partial section through a can-annular combustor center nozzle with a swirler device of known high-swirl angle configuration.

FIG. 1 illustrates a portion of a fuel nozzle 10 typically used in a "can-annular" gas turbine combustor where one center nozzle is surrounded by several (e.g., four or five) outer nozzles. For example, if four outer nozzles are used, they may be spaced at 90° intervals about the center nozzle. If five outer nozzles are used, they may be spaced at 72° intervals about the center nozzle. Alternatively, the nozzles may be unevenly spaced about the center nozzle. Each nozzle 10 is partially defined by a plurality of concentrically arranged tubes forming passages for the supply of fuel and air to the combustion chamber. For purposes of this invention, the nozzle may include a gas fuel supply tube 12 (forming a fuel passage) with an inlet end 14 for supplying gas fuel for combustion in the combustion chamber 16 (see FIG. 7). A tube 18 with an inlet end 20 surrounds the tube 12, forming a passage 22 for supplying air to the combustion process. A swirler 24 is secured to the tube 12 and includes a plurality of vanes 26 arranged about the circumference of tube 12, extending radially into the air passage 22. Fuel in passage 14 flows through the vanes via internal passages 28 and is injected into the passage 20 via injection orifices 30. The vanes 26 are configured to establish a swirl angle at their respective trailing edges 32 (FIG. 2) relative to the axis of the nozzle. In this way, the fuel and air within passage 22 are thoroughly mixed before reaching the combustion chamber. The current practice is to have the vanes 26 shaped to provide a swirl angle at the trailing edges 32 of about 40°–50° (typically 45°) as shown in FIG. 2.

A 45° swirl angle is high enough to aerodynamically stabilize and anchor the flame via vortex breakdown. To this point, the nozzle and associated swirler construction as described is known in the art and need not be described in further detail.

Figure 2:
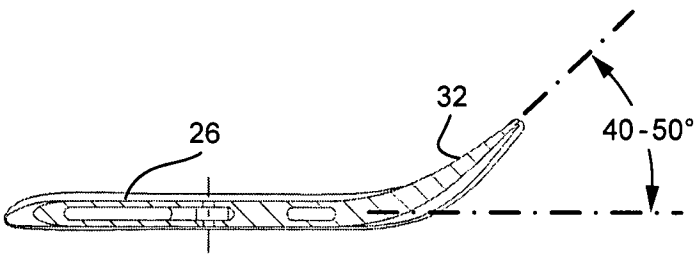
Fig. 2 (Prior Art)
FIG. 2 is a section taken along line 2—2 in FIG. 1.
Figure 4:
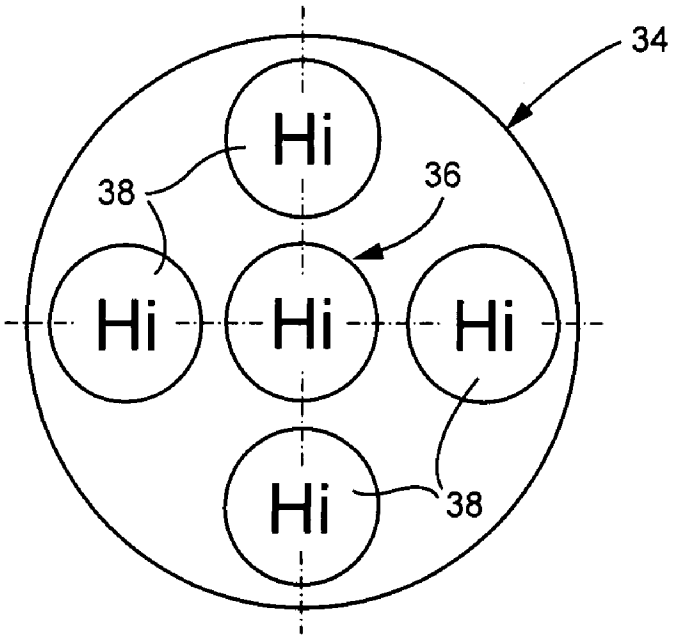
Fig. 4 (Prior Art)
FIG. 4 is a schematic view of the back end of a can-annular combustor, showing an arrangement of five high-swirl nozzles in accordance with the prior art.

Typically, as shown in FIG. 4, a combustor 34 includes a center nozzle 36 surrounded by, for example, four radially outer nozzles 38, all of which have swirlers with high-swirl angles as shown in FIGS. 1 and 2.

Figure 3:
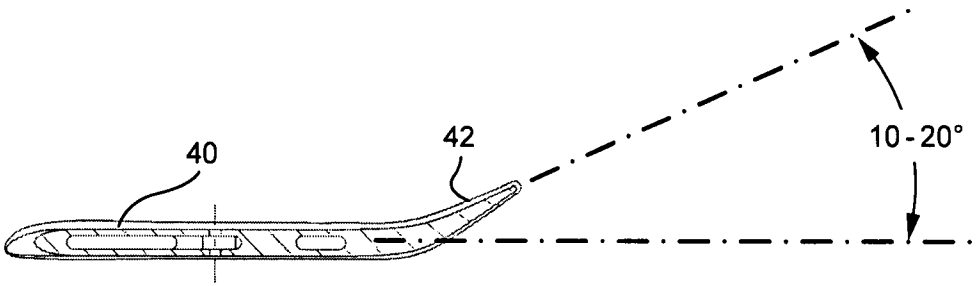
FIG. 3 is a section similar to FIG. 2 but showing a lower swirl angle in accordance with the invention.

In accordance with one exemplary embodiment of this invention, as shown in FIG. 3, the swirler 24 is modified for the center nozzle only so that each vane 40 is shaped at its trailing edge 42 to provide a swirl angle less than 30° and preferably between 10° and 20° to thereby produce a relatively weak vortex structure and detached flame.

Figure 5:
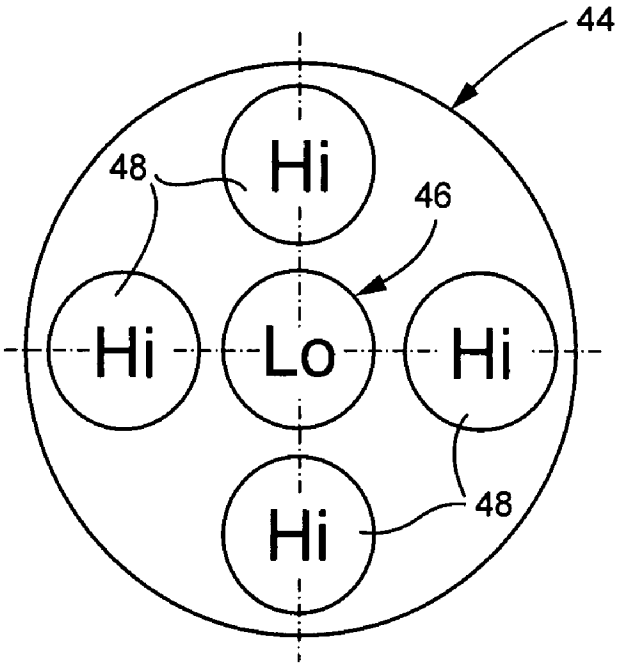
FIG. 5 is a schematic diagram similar to FIG. 5 but illustrating an arrangement of high-swirl nozzles about a center low-swirl nozzle.

Now, as shown in FIG. 5, a modified arrangement for the combustor 44 includes a center nozzle 46 with a swirler 24 (FIG. 1) having vanes 40 shaped to produce a low-swirl angle of less than 30° and preferably between 10° and 20°) while the surrounding nozzles 48 continue to incorporate swirlers with vanes 26 (FIG. 2) shaped to produce a high-swirl angles as described above.

Figure 6:
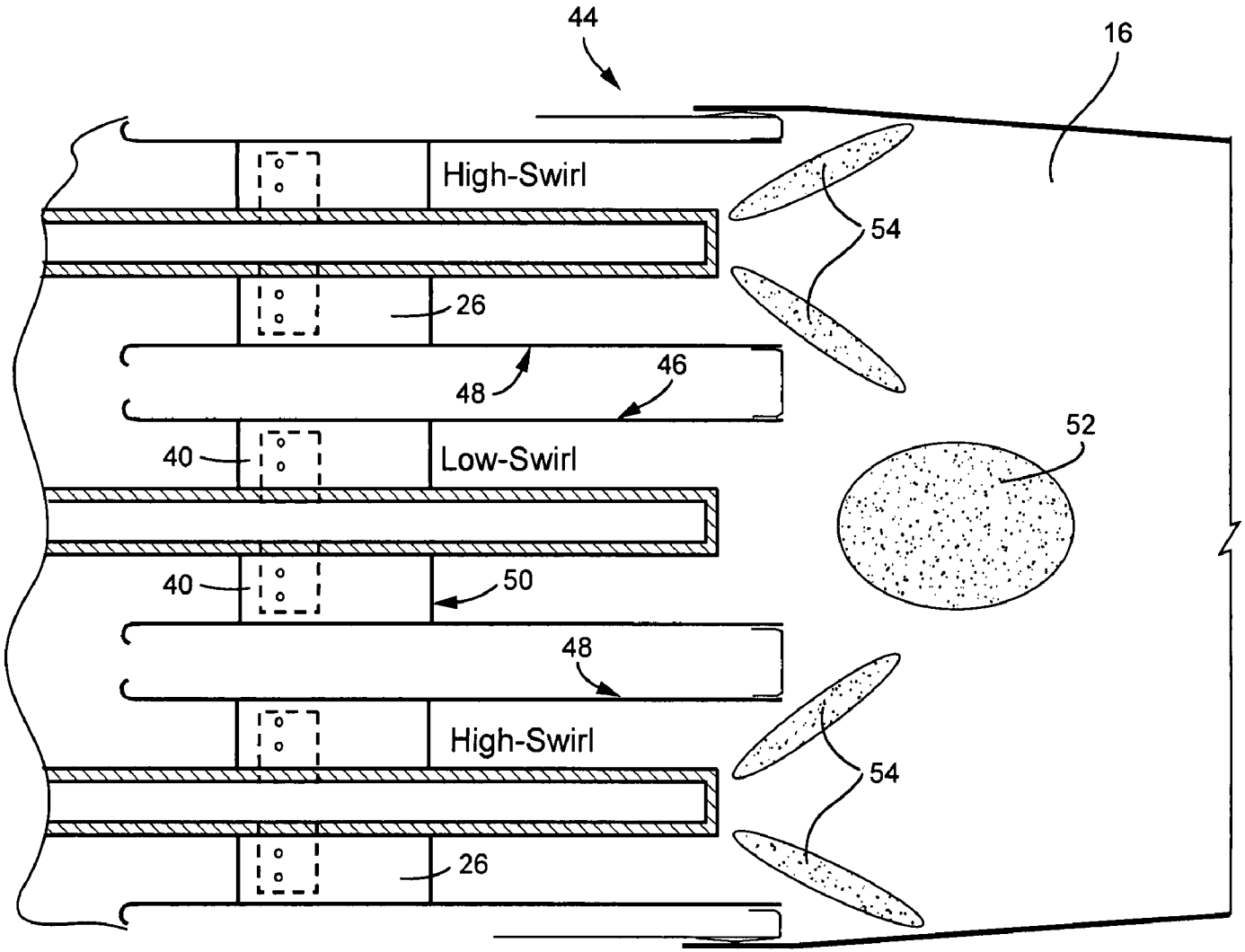
FIG. 6 is a simplified cross-section through a can-annular combustor illustrating the flame pattern achieved with nozzles arranged as shown in FIG. 5.

Turning now to FIG. 6, the can-annular combustor 44 is shown in cross-section, with the low-swirl center nozzle 46 surrounded by the high-swirl outer nozzles 48 (two of which are shown) as in FIG. 5. The center nozzle 46 includes a swirler 50 having vanes 40 as shown in FIG. 3 while outer nozzles 48 incorporate swirlers 24 having vanes 26 as shown in FIG. 2. Thus, the center nozzle flame 52 is detached under all operating conditions and is stabilized by the surrounding flames 54 of the outer nozzles 48 that remain attached to the outer nozzles. This arrangement avoids the potential for the center nozzle to incur high dynamics close to the transition between flame attachment and detachment. The gas fuel from the center nozzle burns further downstream in the combustion chamber, encounters lower residence time and results in lower NOx emissions.

In a second embodiment, the above described arrangement may be reversed so that center nozzle 46 incorporates a swirler with vanes configured to produce a high-swirl angle, and surrounding outer nozzles 48 each incorporate a swirler with vanes configured to produce a low-swirl angle. In this embodiment, the center flame remains attached to the central nozzle while the outer flames are detached from the outer nozzles, also resulting in lower $NO_x$ emissions.

The improvement in NOx-dynamics tradeoff may be further enhanced by enlarging the center nozzle relative to the outer nozzles, reducing the total fraction of fuel that is burned at richer conditions.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A combustor comprising a center nozzle surrounded by a plurality of outer nozzles, said center nozzle and each of said outer nozzles having a fuel passage and an air passage, with a swirler surrounding said fuel passage and having a plurality of vanes projecting radially within said air passage, each vane having a trailing edge arranged at a swirl angle relative to a longitudinal axis of the nozzle, wherein the swirl angle for the swirler in said center nozzle is less than 30° and the swirl angle for the swirlers in said plurality of outer nozzles is between 40°–50°.

2. The combustor of claim 1 wherein said angle is between 10°–20° for said center nozzle.

3. The combustor of claim 1 wherein said plurality of outer nozzles comprises four nozzles spaced at 90° intervals about said center nozzle.

4. The combustor of claim 1 wherein said plurality of outer nozzles comprises five nozzles spaced at 72° intervals about said center nozzle.

5. The combustor of claim 1 wherein said plurality of outer nozzles are not equally spaced about said center nozzle.

6. The combustor of claim 1 wherein said vanes include internal passages and injection orifices for injecting fuel into said air passage.

7. A method for reducing $NO_x$ in a can-annular combustor comprising the steps of:

(a) arranging a plurality of outer nozzles in an annular array about a center nozzle, each nozzle having a fuel passage and an air passage;

(b) incorporating a swirler in the center nozzle supporting the fuel passage having vanes with injection orifices for injecting fuel into the air passage, each vane shaped to create a first swirl angle relative to a longitudinal axis of the center nozzle of less than 30°; and (c) incorporating swirlers in each of said outer nozzles surrounding the fuel passages having vanes with injection orifices for injecting fuel into the air passage, each vane shaped to create second swirl angle relative to a longitudinal axis of the respective outer nozzles of between 40°–50°.

8. The method of claim 7 wherein said first predetermined swirl angle is between 10° and 20°.

* * * * *

UNITED STATES PATENT AND TRADEMARK OFFICE

CERTIFICATE OF CORRECTION

PATENT NO. : 7,137,258 B2
APPLICATION NO. : 10/859238
DATED : November 21, 2006
INVENTOR(S) : Widener It is certified that error appears in the above-identified patent and that said Letters Patent is hereby corrected as shown below:

At column 2 line 2 the word "combusto◦mprising" should read as --combustor comprising--

At column 2 line 12 the entire second paragraph should be deleted.

Signed and Sealed this

Tenth Day of April, 2007

JON W. DUDAS
*Director of the United States Patent and Trademark Office*